US012044102B1

(12) United States Patent
Wallace et al.

(10) Patent No.: US 12,044,102 B1
(45) Date of Patent: Jul. 23, 2024

(54) CONSTANTLY ADAPTIVE VOID ELIMINATION SYSTEM

(71) Applicant: Halliburton Energy Services, Inc., Houston, TX (US)

(72) Inventors: Scott Wallace, Aberdeenshire (GB); Barry Main, Aberdeenshire (GB); Peter D W Inglis, Arbroath (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/236,451

(22) Filed: Aug. 22, 2023

(51) Int. Cl.
*E21B 33/12* (2006.01)
*E21B 33/128* (2006.01)
*E21B 34/10* (2006.01)

(52) U.S. Cl.
CPC ..... *E21B 34/101* (2013.01)

(58) Field of Classification Search
CPC .... E21B 33/12; E21B 33/128; E21B 33/1285; E21B 34/101
See application file for complete search history.

(56) References Cited

U.S. PATENT DOCUMENTS

2011/0133740 A1 6/2011 Seydoux et al.
2016/0047239 A1 2/2016 Hou et al.
2016/0124108 A1 5/2016 Wu
2016/0282502 A1 9/2016 Sharma et al.
2016/0282512 A1 9/2016 Donderici et al.

FOREIGN PATENT DOCUMENTS

CA 3138587 C 6/2020
RU 2739813 C1 * 12/2020 ..... E21B 33/1295
RU 2749366 C1 * 6/2021 ..... E21B 33/12

OTHER PUBLICATIONS

International Search Report and Written Opinion for International Patent Application No. PCT/US2023/086277 dated May 14, 2024. PDF file. 11 pages.

* cited by examiner

*Primary Examiner* — Matthew R Buck
(74) *Attorney, Agent, or Firm* — Scott Richardson; C. Tumey Law Group PLLC

(57) ABSTRACT

A method for sealing a borehole, that includes lowering a plug into the borehole, where the plug includes a sealing element, a reservoir that includes a liquid, and a one-way valve connected to the reservoir, causing the sealing element to undergo sealing element expansion, where the sealing element expansion causes the sealing element to make circumferential contact with a casing of the borehole, and where the sealing element expansion causes the sealing element to create a void.

20 Claims, 8 Drawing Sheets

CONSTANTLY ADAPTIVE VOID ELIMINATION SYSTEM

BACKGROUND

The oil and gas industry may use boreholes as fluid conduits to access subterranean deposits of various fluids and minerals which may include hydrocarbons. A drilling operation may be utilized to construct the fluid conduits which are capable of producing hydrocarbons disposed in subterranean formations. Wellbores may be incrementally constructed as tapered sections, which sequentially extend into a subterranean formation.

The widest diameter sections may be located near the surface of the earth while the narrowest diameter sections may be disposed at the toe of the well. For example, starting at the surface of the earth, the borehole sections which make up a borehole may include any combination of a conductor borehole, one or more surface boreholes, one or more intermediate boreholes, a pilot borehole, and/or a production borehole. The diameter of the foregoing borehole sections may sequentially decrease in diameter from the conductor borehole to the production borehole.

In some examples, the design, operational, equipment, and fluid parameters may be different for each borehole section. Prior to executing a drilling operation, it may be beneficial to construct a drilling plan which incorporates multi-disciplinary data including engineering and geological data.

BRIEF DESCRIPTION OF DRAWINGS

These drawings illustrate certain aspects of some examples of the present disclosure and should not be used to limit or define the disclosure.

DETAILED DESCRIPTION

Overview and Advantages

In general, this application discloses one or more embodiments of methods and systems for preventing undesirable movement and reshaping of a sealing element of a plug used to isolate volumes in the casing of a borehole.

In conventional plugs, when a sealing element is expanded to circumscribe the internal diameter of casing, voids of gaseous matter may be formed in pockets around the sealing element. In turn, when the sealing element experiences external pressure(s), the sealing element may partially collapse inward, shifting portions of the sealing element into the void(s). Consequently, the effectiveness of the sealing element (and the plug overall) may suffer due to this movement and reshaping.

As disclosed in one or more embodiments herein, liquid (an incompressible fluid) may be injected into the voids. Then, once the voids are filled with liquid, the sealing element cannot move and shift into the voids, as the voids are already occupied by incompressible matter. Further, the liquid may be held in a reservoir prior to injection, and injected only when necessary into the voids (e.g., "adaptively"). Such an adaptive system may be implemented via a reservoir partially enclosed by a flexible membrane which is exposed to volume with greater pressure. Accordingly, when the relative pressure increases, the membrane is forced into the reservoir, displacing the liquid into the void.

Using the methods and systems disclosed herein, the sealing element may maintain more consistent contact with the casing. The life of the sealing element may be prolonged as the sealing element experiences less movement and wear resulting therefrom. And, there is a reduced risk of plug failure, as the sealing element is provided with less opportunity to separate from the borehole casing (e.g., partial separation leading to total separation).

—FIG. 1—

Figure 1:
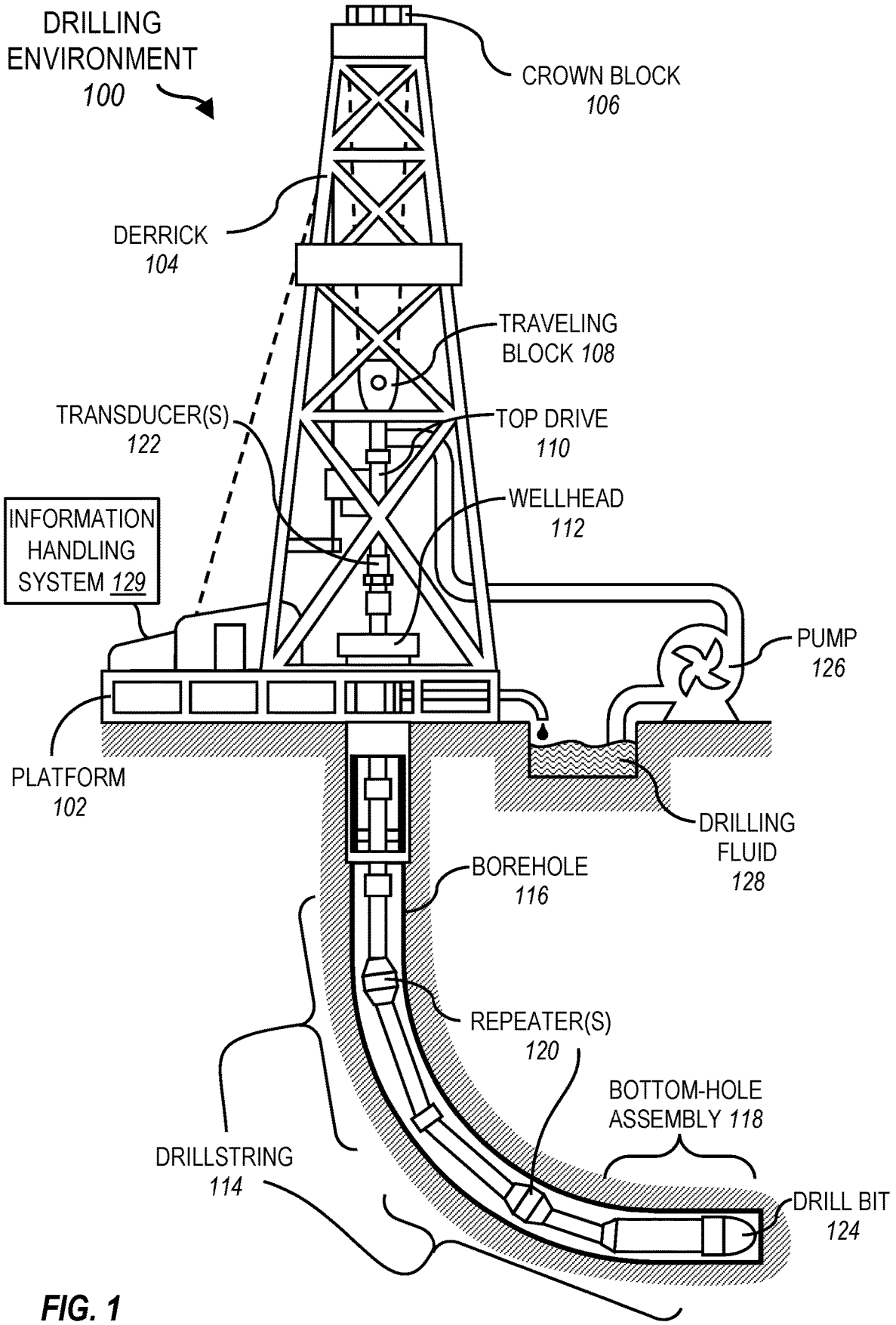
FIG. 1 is a diagram of an example drilling environment.

FIG. 1 is a diagram of an example drilling environment. Drilling environment 100 may include drilling platform 102 that supports derrick 104 having a traveling block 108 for raising and lowering top drive 110 and drillstring 114. Top drive 110 supports and rotates drillstring 114 as it is lowered through wellhead 112. In turn, drill bit 124, located at the end of drillstring 114, may create borehole 116. Each of these components is described below.

Platform 102 is a structure which may be used to support one or more other components of drilling environment 100 (e.g., derrick 104). Platform 102 may be designed and constructed from suitable materials (e.g., concrete) which are able to withstand the forces applied by other components (e.g., the weight and counterforces experienced by derrick 104). In any embodiment, platform 102 may be constructed to provide a uniform surface for drilling operations in drilling environment 100.

Derrick 104 is a structure which may support, contain, and/or otherwise facilitate the operation of one or more pieces of the drilling equipment. In any embodiment, derrick 104 may support crown block 106, traveling block 108, and/or any part connected to (and including) drillstring 114. Derrick 104 may be constructed from any suitable materials (e.g., steel) to provide the strength necessary to support those components.

Crown block 106 is one or more simple machine(s) which may be rigidly affixed to derrick 104 and include a set of pulleys (e.g., a "block"), threaded (e.g., "reeved") with a drilling line (e.g., a steel cable), to provide mechanical advantage. Crown block 106 may be disposed vertically above traveling block 108, where traveling block 108 is threaded with the same drilling line.

Traveling block 108 is one or more simple machine(s) which may be movably affixed to derrick 104 and include a set of pulleys, threaded with a drilling line, to provide mechanical advantage. Traveling block 108 may be disposed vertically below crown block 106, where crown block 106 is threaded with the same drilling line. In any embodiment, traveling block 108 may be mechanically coupled to drillstring 114 (e.g., via top drive 110) and allow for drillstring 114 (and/or any component thereof) to be lifted from (and out of) borehole 116. Both crown block 106 and traveling block 108 may use a series of parallel pulleys (e.g., in a "block and tackle" arrangement) to achieve significant mechanical advantage, allowing for the drillstring to handle greater loads (compared to a configuration that uses non-parallel tension). Traveling block 108 may move vertically (e.g., up, down) within derrick 104 via the extension and retraction of the drilling line.

Top drive 110 is a machine which may be configured to rotate drillstring 114. Top drive 110 may be affixed to traveling block 108 and configured to move vertically within derrick 104 (e.g., along with traveling block 108). In any embodiment, the rotation of drillstring 114 (caused by top drive 110) may cause drillstring 114 to form borehole 116. Top drive may use one or more motor(s) and gearing mechanism(s) to cause rotations of drillstring 114. In any embodiment, a rotatory table (not shown) and a "Kelly" drive (not shown) may be used in addition to, or instead of, top drive 110.

Wellhead 112 is a machine which may include one or more pipes, caps, and/or valves to provide pressure control for contents within borehole 116 (e.g., when fluidly connected to a well (not shown)). In any embodiment, during drilling, wellhead 112 may be equipped with a blowout preventer (not shown) to prevent the flow of higher-pressure fluids (in borehole 116) from escaping to the surface in an uncontrolled manner. Wellhead 112 may be equipped with other ports and/or sensors to monitor pressures within borehole 116 and/or otherwise facilitate drilling operations.

Drillstring 114 is a machine which may be used to form borehole 116 and/or gather data from borehole 116 and the surrounding geology. Drillstring 114 may include one or more drillpipe(s), one or more repeater(s) 120, and bottom-hole assembly 118. Drillstring 114 may rotate (e.g., via top drive 110) to form and deepen borehole 116 (e.g., via drill bit 124) and/or via one or more motor(s) attached to drillstring 114.

Borehole 116 is a hole in the ground which may be formed by drillstring 114 (and one or more components thereof). Borehole 116 may be partially or fully lined with casing (e.g., casing 230) to protect the surrounding ground from the contents of borehole 116, and conversely, to protect borehole 116 from the surrounding ground.

Bottom-hole assembly 118 is a machine which may be equipped with one or more tools for creating, providing structure, and maintaining borehole 116, as well as one or more tools for measuring the surrounding environment (e.g., measurement while drilling (MWD), logging while drilling (LWD)). In any embodiment, bottom-hole assembly 118 may be disposed at (or near) the end of drillstring 114 (e.g., in the most "downhole" portion of borehole 116).

Non-limiting examples of tools that may be included in bottom-hole assembly 118 include a drill bit (e.g., drill bit 124), casing tools (e.g., a shifting tool), a plugging tool (e.g., plug 119), a mud motor, a drill collar (thick-walled steel pipes that provide weight and rigidity to aid the drilling process), actuators (and pistons attached thereto), a steering system, and any measurement tool (e.g., sensors, probes, particle generators, etc.).

Further, bottom-hole assembly 118 may include a telemetry sub to maintain a communications link with the surface (e.g., with information handling system 129). Such telemetry communications may be used for (i) transferring tool measurement data from bottom-hole assembly 118 to surface receivers, and/or (ii) receiving commands (from the surface) to bottom-hole assembly 118 (e.g., for use of one or more tool(s) in bottom-hole assembly 118).

Non-limiting examples of techniques for transferring tool measurement data (to the surface) include mud pulse telemetry and through-wall acoustic signaling. For through-wall acoustic signaling, one or more repeater(s) 120 may detect, amplify, and re-transmit signals from bottom-hole assembly 118 to the surface (e.g., to information handling system 129), and conversely, from the surface (e.g., from information handling system 129) to bottom-hole assembly 118.

Repeater 120 is a device which may be used to receive and send signals from one component of drilling environment 100 to another component of drilling environment 100. As a non-limiting example, repeater 120 may be used to receive a signal from a tool on bottom-hole assembly 118 and send that signal to information handling system 129. Two or more repeaters 120 may be used together, in series, such that a signal to/from bottom-hole assembly 118 may be relayed through two or more repeaters 120 before reaching its destination.

Transducer 122 is a device which may be configured to convert non-digital data (e.g., vibrations, other analog data) into a digital form suitable for information handling system 129. As a non-limiting example, one or more transducer(s) 122 may convert signals between mechanical and electrical forms, enabling information handling system 129 to receive the signals from a telemetry sub, on bottom-hole assembly 118, and conversely, transmit a downlink signal to the telemetry sub on bottom-hole assembly 118. In any embodiment, transducer 122 may be located at the surface and/or any part of drillstring 114 (e.g., as part of bottom-hole assembly 118).

Drill bit 124 is a machine which may be used to cut through, scrape, and/or crush (i.e., break apart) materials in the ground (e.g., rocks, dirt, clay, etc.). Drill bit 124 may be disposed at the frontmost point of drillstring 114 and bottom-hole assembly 118. In any embodiment, drill bit 124 may include one or more cutting edges (e.g., hardened metal points, surfaces, blades, protrusions, etc.) to form a geometry which aids in breaking ground materials loose and further crushing that material into smaller sizes. In any embodiment, drill bit 124 may be rotated and forced into (i.e., pushed against) the ground material to cause the cutting, scraping, and crushing action. The rotations of drill bit 124 may be caused by top drive 110 and/or one or more motor(s) located on drillstring 114 (e.g., on bottom-hole assembly 118).

Pump 126 is a machine that may be used to circulate drilling fluid 128 from a reservoir, through a feed pipe, to derrick 104, to the interior of drillstring 114, out through drill bit 124 (through orifices, not shown), back upward through borehole 116 (around drillstring 114), and back into the reservoir. In any embodiment, any suitable pump 126 may be used (e.g., centrifugal, gear, etc.) which is powered by any suitable means (e.g., electricity, combustible fuel, etc.).

Drilling fluid 128 is a liquid which may be pumped through drillstring 114 and borehole 116 to collect drill cuttings, debris, and/or other ground material from the end of borehole 116 (e.g., the volume most recently hollowed by drill bit 124). Further, drilling fluid 128 may provide conductive cooling to drill bit 124 (and/or bottom-hole assembly 118). In any embodiment, drilling fluid 128 may be circulated via pump 126 and filtered to remove unwanted debris.

Information handling system 129 is a hardware computing device which may be utilized to perform various steps, methods, and techniques disclosed herein (e.g., via the execution of software). In any embodiment, information handling system 129 may include one or more processor(s), cache, memory, storage, and/or one or more peripheral device(s). Any two or more of these components may be operatively connected via a system bus that provides a means for transferring data between those components.

Information handling system 129 may be operatively connected to drillstring 114 (and/or other various components of the drilling environment). In any embodiment, information handling system 129 may utilize any suitable form of wired and/or wireless communication to send and/or receive data to and/or from other components of drilling environment 100. In any embodiment, information handling system 129 may receive a digital telemetry signal, demodulate the signal, display data (e.g., via a visual output device), and/or store the data. In any embodiment, information handling system 129 may send a signal (with data) to one or more components of drilling environment 100 (e.g., to control one or more tools on bottom-hole assembly 118).

Figure 2A:
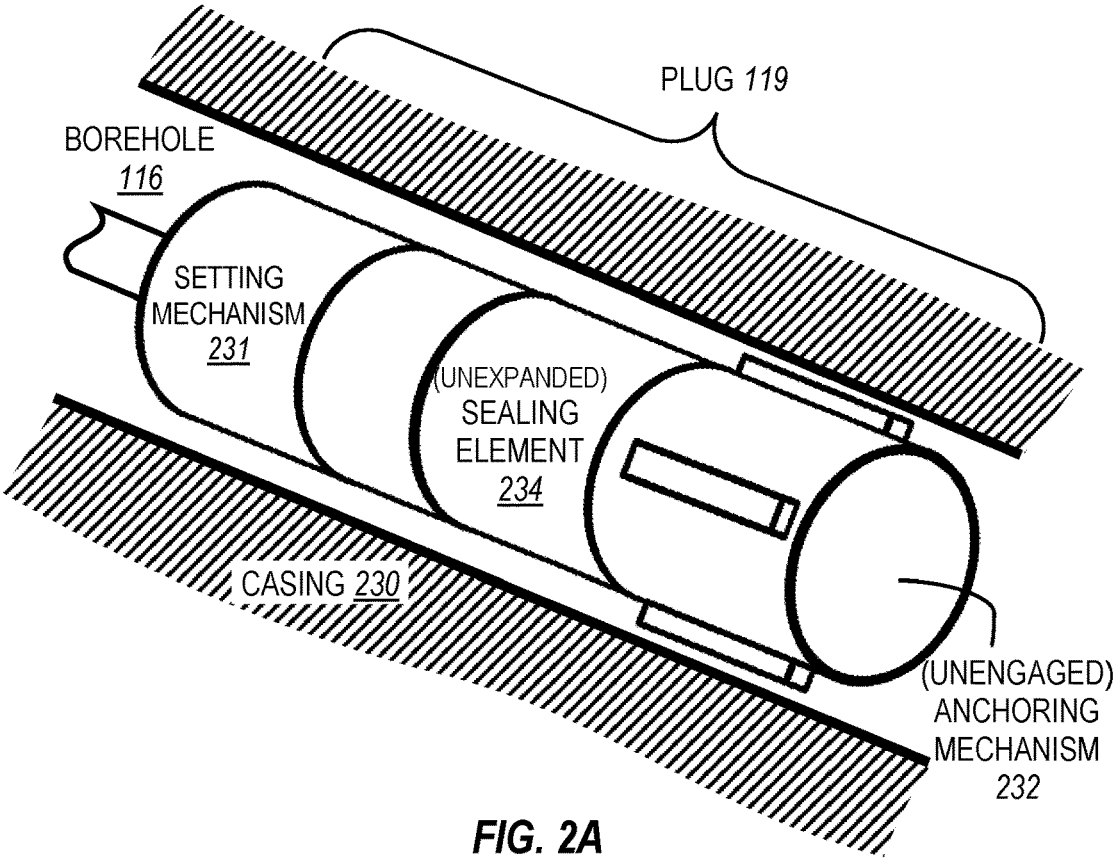
FIG. 2A is a diagram of an example plug in a casing, prior to expansion of the sealing element.
Figure 2B:
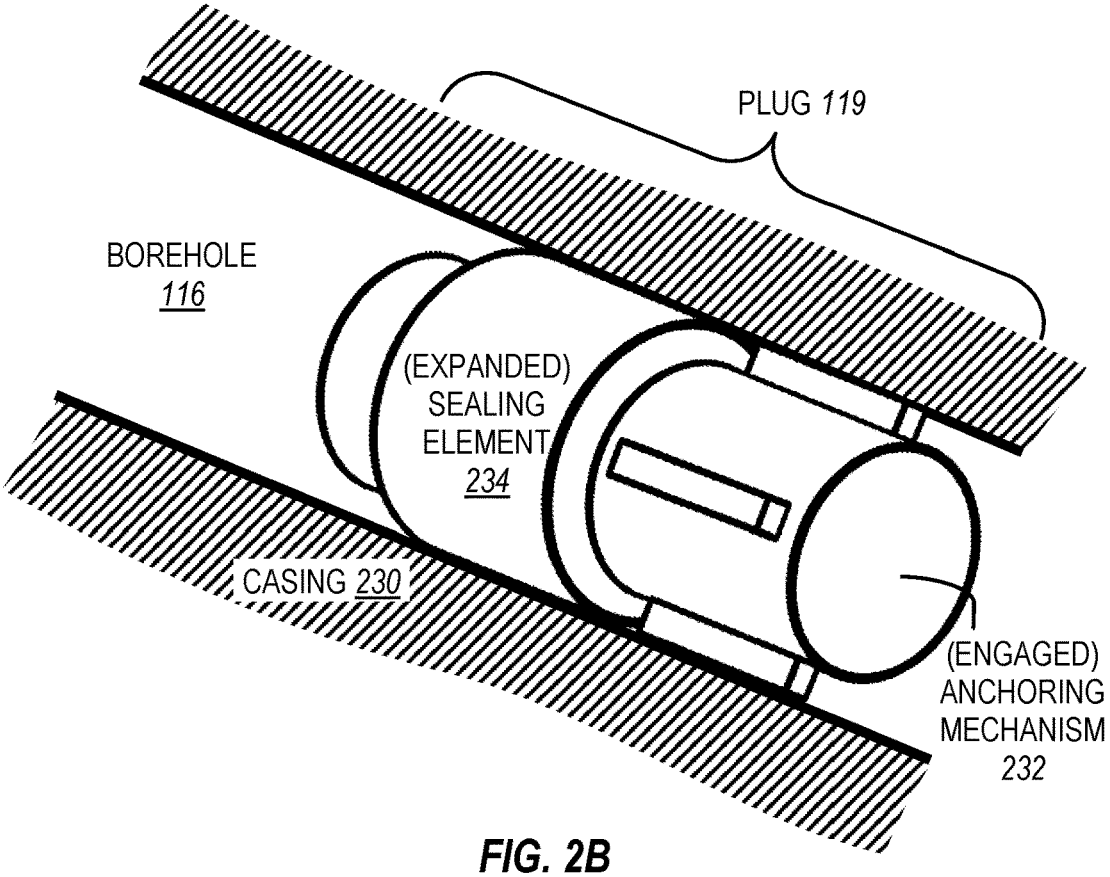
FIG. 2B is a diagram of an example plug in a casing, after expansion of the sealing element.

—FIGS. 2A and 2B—

FIGS. 2A and 2B are diagrams of an example plug in a casing. Plug 119 may be in borehole 116 which is lined with casing 230. Further, plug 119 may include sealing element 234, setting mechanism 231, and anchoring mechanism 232.

Casing 230 is a structure which is rigidly fixed inside borehole 116. In any embodiment, casing 230 may be constructed from steel pipe(s) cemented into borehole 116. The interior of casing 230 may form a volume in which drillstring 114 may translate and rotate to continue forming borehole 116 (e.g., drilling). Casing 230 may provide structure to separate and prevent interaction between the contents of borehole 116 and the ground around borehole 116. Further, in any embodiment, casing 230 may include one or more means for rigidly affixing to one or more components of drillstring 114 (e.g., a socket and/or groove in casing 230 where anchoring mechanism 232 may detachably latch).

Plug 119 is a machine which is configured to create a seal in casing 230. In any embodiment, plug 119 may be used to create a physical separation between two volumes of borehole 116 thereby preventing the transmission of fluids from one volume (e.g., downhole) to a second volume (e.g., uphole), or vice versa. To achieve sealing of casing 230, plug 119 may include sealing element 234 (to separate the volumes of borehole 116) and be removably affixed to anchoring mechanism 232 (for rigidly attaching to casing 230).

Anchoring mechanism 232 is a machine which is configured to interlock with casing 230 (e.g., "unengaged" when not locked into casing 230, "engaged" when locked into casing 230). In any embodiment, casing 230 may include one or more receptacles which are complementary to protrusions of anchoring mechanism 232. Anchoring mechanism 232 may be configured to movably extend (and retract) one or more protrusions to interact with the receptacle(s) of casing 230. When anchoring mechanism 232 is interlocked with casing 230, plug 119 may be rigidly fixed with respect to casing 230.

Sealing element 234 is a machine which is configured to circumferentially press against the internal diameter of casing 230. In any embodiment, sealing element 234 may be reshaped (e.g., pressed, squeezed, folded, etc.) to cause sealing element 234 to expand outward (i.e., forming a larger outer diameter) and make contact against casing 230. Sealing element 234 may be reshaped (e.g., caused to expand) by one or more other components of plug 119 (e.g., gauge ring 338). Sealing element 234 may be made from any elastomer and/or compound thereof.

Setting mechanism 231 is a machine which is configured to interlock with the other components of plug 119 and drillstring 114 (or other wireline). Setting mechanism 231 may be detachably affixed to the other components of plug 119 (e.g., sealing element 234, anchoring mechanism 232) and may be remotely detached after the anchoring mechanism 232 is engaged and sealing element 234 is expanded. Further, setting mechanism 231 may be reutilized later to remove plug 119 from borehole 116. In such an instance, setting mechanism 231 would be lowered to plug 119, reengaged with the other components, sealing element 234 would be unexpanded, anchoring mechanism 232 detached, and the entire plug 119 may be removed.

—FIG. 3A—

Figure 3A:
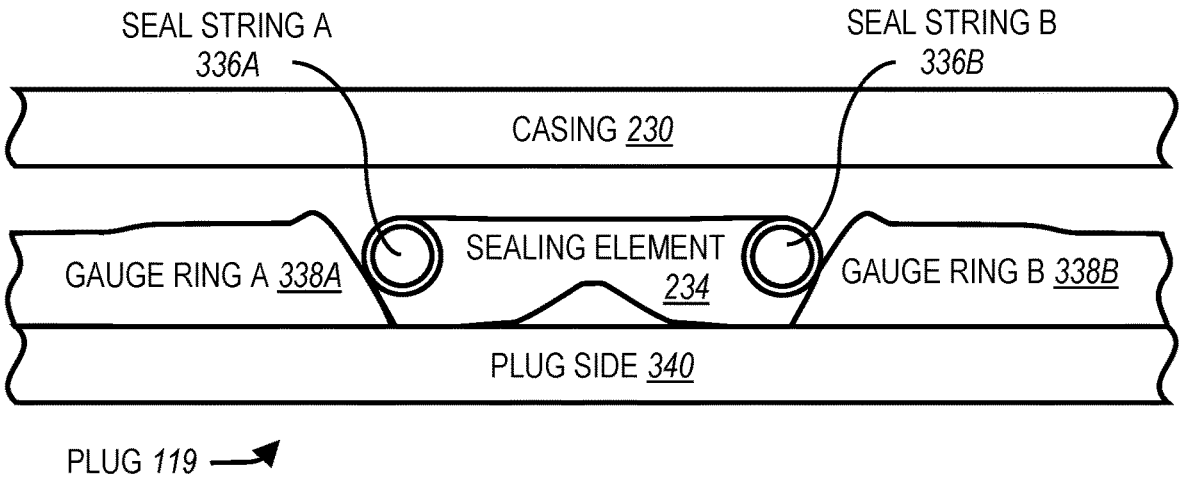
FIG. 3A is a sectional view of a portion of an example conventional plug and a casing, prior to expansion of the sealing element.

FIG. 3A is a sectional view of a portion of an example conventional plug and a casing, prior to expansion of the sealing element.

Seal string 336 is a component of sealing element 234 which may provide additional structural support to sealing element 234. In any embodiment, seal string 336 is a structure that may withstand higher pressures (compared to other portions of sealing element 234) before experiencing plastic deformation. Accordingly, seal string(s) 336 may be used to contain (e.g., "hold back") the main body of sealing element 234 and prevent the material of sealing element 234 from extruding past one or more gauge ring(s) 338 and into borehole 116.

Gauge ring 338 is a component of plug 119 which may be used to hold back and/or reshape sealing element 234. Gauge ring 338 may circumscribe plug 119 to form an annulus on one side of sealing element 234 (with another gauge ring 338 disposed on the other side). Further, gauge ring 338 may be configured to slide along the length of plug 119 (against plug side 340) to press against sealing element 234. Another gauge ring 338, or any other rigid body, may be positioned on the opposite side of sealing element 234 to counteract the forces exerted by the opposing gauge ring 338.

Plug side 340 is a structural element which may form a wall of plug 119. In any embodiment, plug 119 may include exterior components that move (e.g., slide) along plug 119, where plug side 340 is stationary (relative to the movable components). In any embodiment, plug side 340 may be stationary with respect to casing 230.

—FIG. 3B—

Figure 3B:
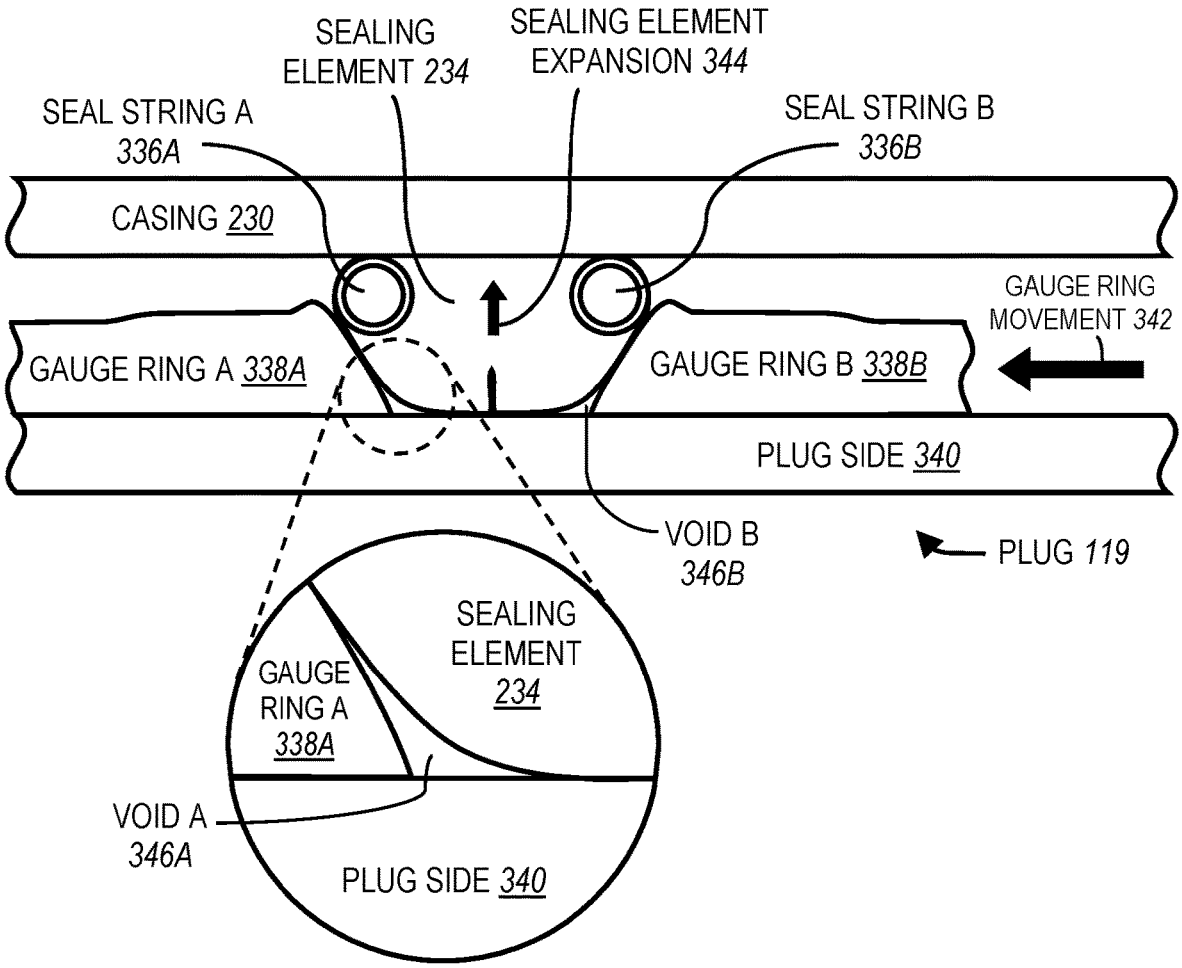
FIG. 3B is a sectional view of a portion of an example conventional plug and a casing, after expansion of the sealing element.

FIG. 3B is a sectional view of a portion of an example conventional plug and a casing, after expansion of the sealing element.

Gauge ring movement 342 is the motion of gauge ring 338 that causes sealing element 234 to undergo sealing element expansion 344. In any embodiment, gauge ring movement 342 is the relative motion between a gauge ring (e.g., gauge ring B 338B, as shown in FIG. 3B) and a sealing element 234. As shown in the example of FIG. 3B, gauge ring A 338A remains stationary and does not undergo gauge ring movement 342. Gauge ring movement 342 may be caused by one or more actuator(s) (not shown), tension or compression on plug 119 (overall) while one or more gauge ring(s) are held stationary (e.g., via drillstring 114), and/or any other means of sliding gauge ring 338.

Sealing element expansion 344 is the motion (e.g., deformation, reshaping) of sealing element 234. In any embodiment, sealing element expansion 344 is caused by gauge ring movement 342 and/or the compression of sealing element 234 between two gauge rings 338. Sealing element expansion 344 may cause sealing element 234 to expand radially outward (i.e., forming a larger outer diameter) so as to make contact with casing 230. Sealing element expansion 344 may cause one or more void(s) 346 to be created in and/or around plug 119.

Void 346 is a volume formed by sealing element expansion 344. In any embodiment, void 346 exists between sealing element 234, gauge ring 338, and plug side 340. Void 346 may be filled with a gaseous fluid that exists within borehole 116. As void 346 may be filled with a compressible fluid (e.g., a gas), sealing element 234 has the potential to move into void 346.

—FIG. 3C—

Figure 3C:
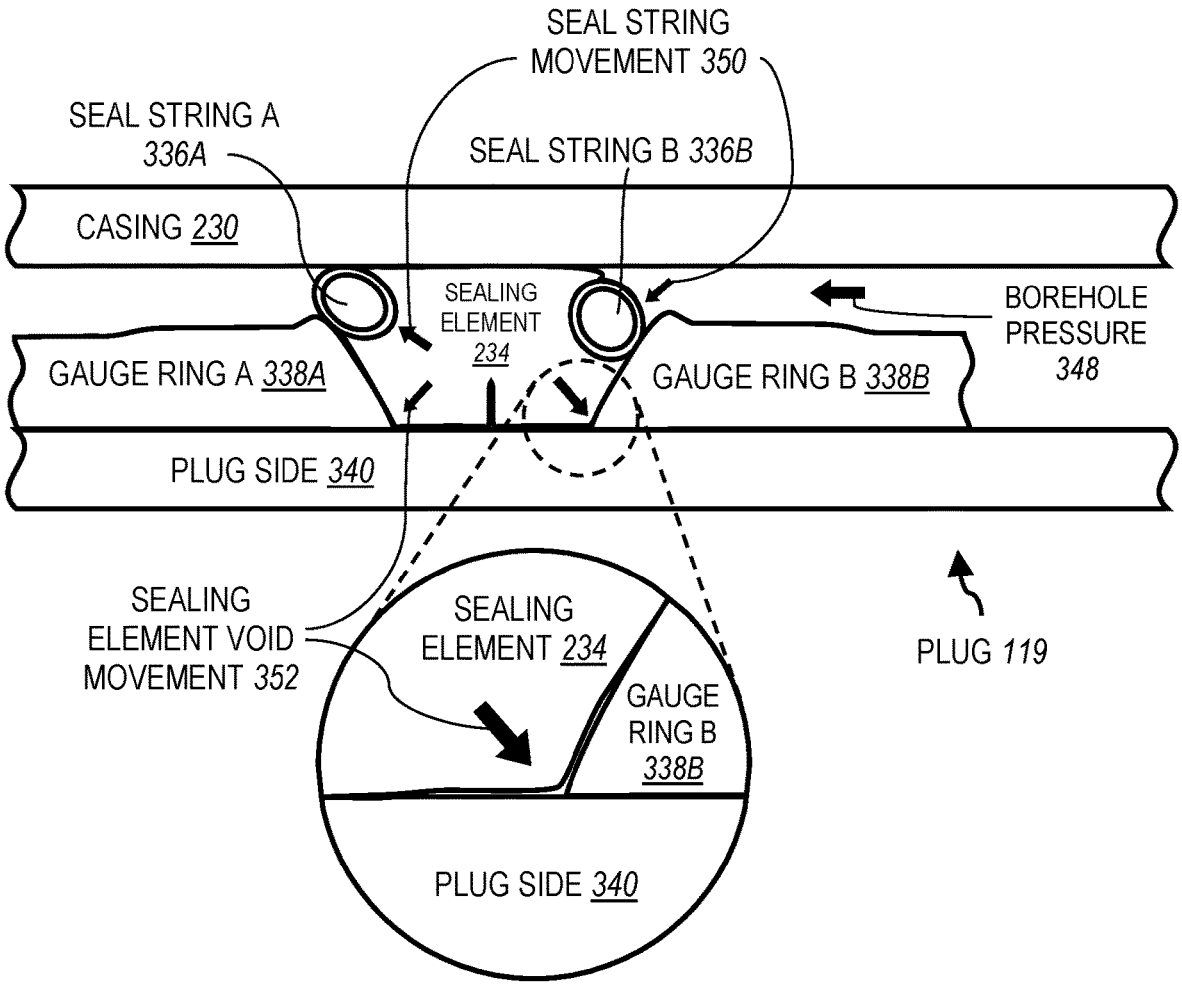
FIG. 3C is a sectional view of a portion of an example conventional plug and a casing, with deformation of the sealing element.

FIG. 3C is a sectional view of a portion of an example conventional plug and a casing, with deformation of the sealing element caused by borehole pressure.

Borehole pressure 348 is an increase in pressure felt by one or more side(s) of sealing element 234. The pressure (creating borehole pressure 348) is relatively higher compared against the pressure existing in void 346. In turn, due to the pressure differential, sealing element 234 may undergo seal string movement 350 and sealing element void movement 352 (to fill the comparatively lower pressure in void 346). Further, borehole pressure 348 may occur (i) only on one side of sealing element 234, (ii) on both sides of sealing element 234 simultaneously, (iii) staggered on opposite sides of sealing element 234, or (iv) not at all.

In any embodiment, a temperature differential on one (or both) sides of borehole 116 may also cause sealing element void movement 352 and seal string movement 350. A temperature differential may cause one or more component(s) to expand or contract (at differing rates) therefore causing sealing element 234 to (at least partially) fill void 346.

Seal string movement 350 is motion of one or more seal string(s) 336 caused by borehole pressure 348 (and/or a temperature differential). In any embodiment, the seal string 336 closer to the comparatively higher borehole pressure 348 (e.g., seal string B 336B as depicted in FIG. 3C) is pushed into the main body of sealing element 234. Whereas the seal string 336 on the opposing side (assuming there is no counteracting borehole pressure 348) is pushed outward away from the main body of sealing element 234 (seal string A 336A, as depicted in FIG. 3C). In any embodiment, seal string movement 350 may (i) result in the plastic deformation of one (or both) seal string(s) 336, (ii) permanently damage sealing element 234, and/or (iii) reduce the effectiveness of plug 119 to separate the volumes of borehole 116 (e.g., partial and/or total failure).

Sealing element void movement 352 is the movement of sealing element 234 into one or more void(s) 346. As void 346 is filled with a compressible fluid (e.g., gas) and sealing element 234 is experiencing borehole pressure 348, sealing element 234 is caused to (at least partially) fill void(s) 346. In turn, seal string movement 350 allows for seal string(s) 336 to protrude further into sealing element 234 potentially causing sealing element 234 to (at least partially) move away from casing 230.

—FIG. 4A—

Figure 4A:
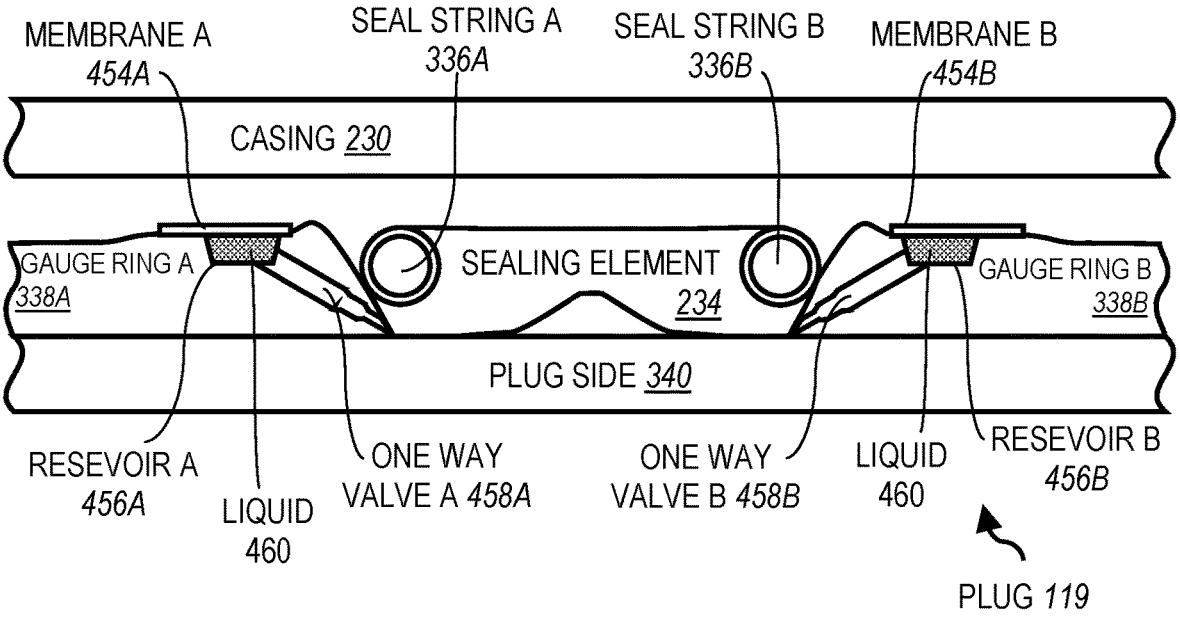
FIG. 4A is a sectional view of a portion of an example plug and a casing, prior to expansion of the sealing element.

FIG. 4A is a sectional view of a portion of an example plug and a casing, prior to expansion of the sealing element.

Membrane 454 is a structure which may flexibly cover reservoir 456. In any embodiment, membrane 454 may be sufficiently flexible as to allow for expansion into reservoir 456 (e.g., membrane movement 462). In turn, when membrane 454 is expanded into reservoir 456, contents of reservoir 456 (e.g., liquid 460) may be forced from reservoir 456 through an orifice (e.g., via one-way valve 458) to another volume (e.g., void 346). In any embodiment, membrane 454 may (wholly or partially) circumscribe plug 119 covering reservoir 456. Plug 119 may include a membrane 454 for each reservoir 456, respectively.

Figure 4B:
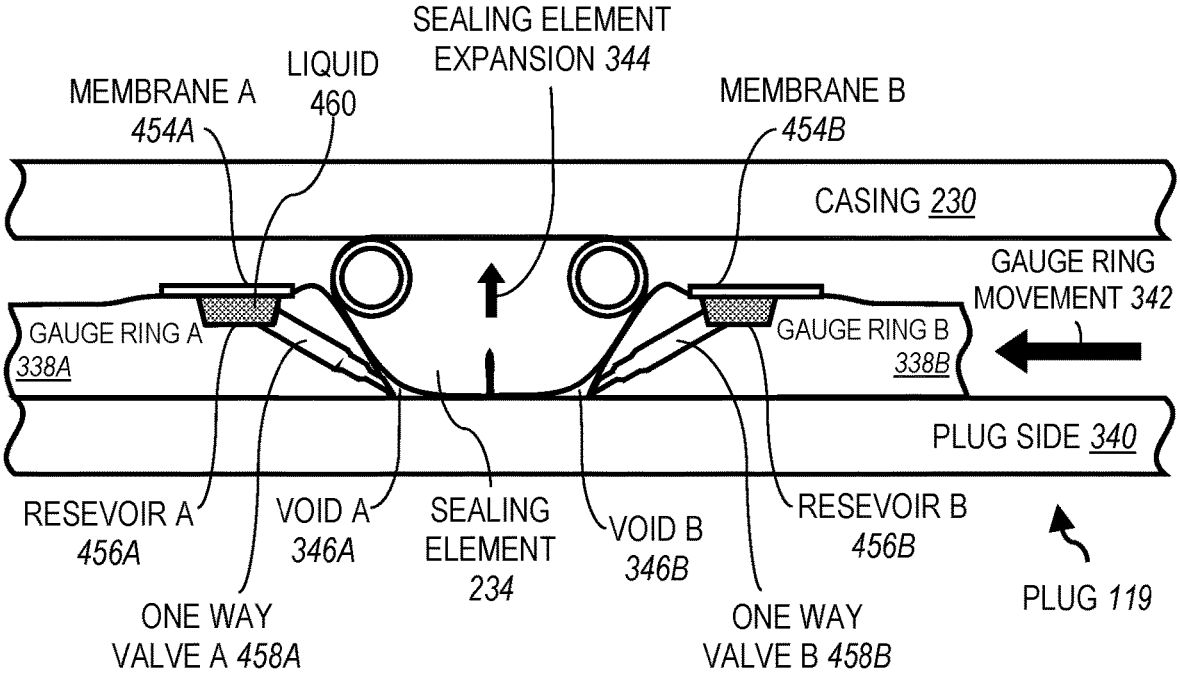
FIG. 4B is a sectional view of a portion of an example plug and a casing, after expansion of the sealing element.
Figure 4C:
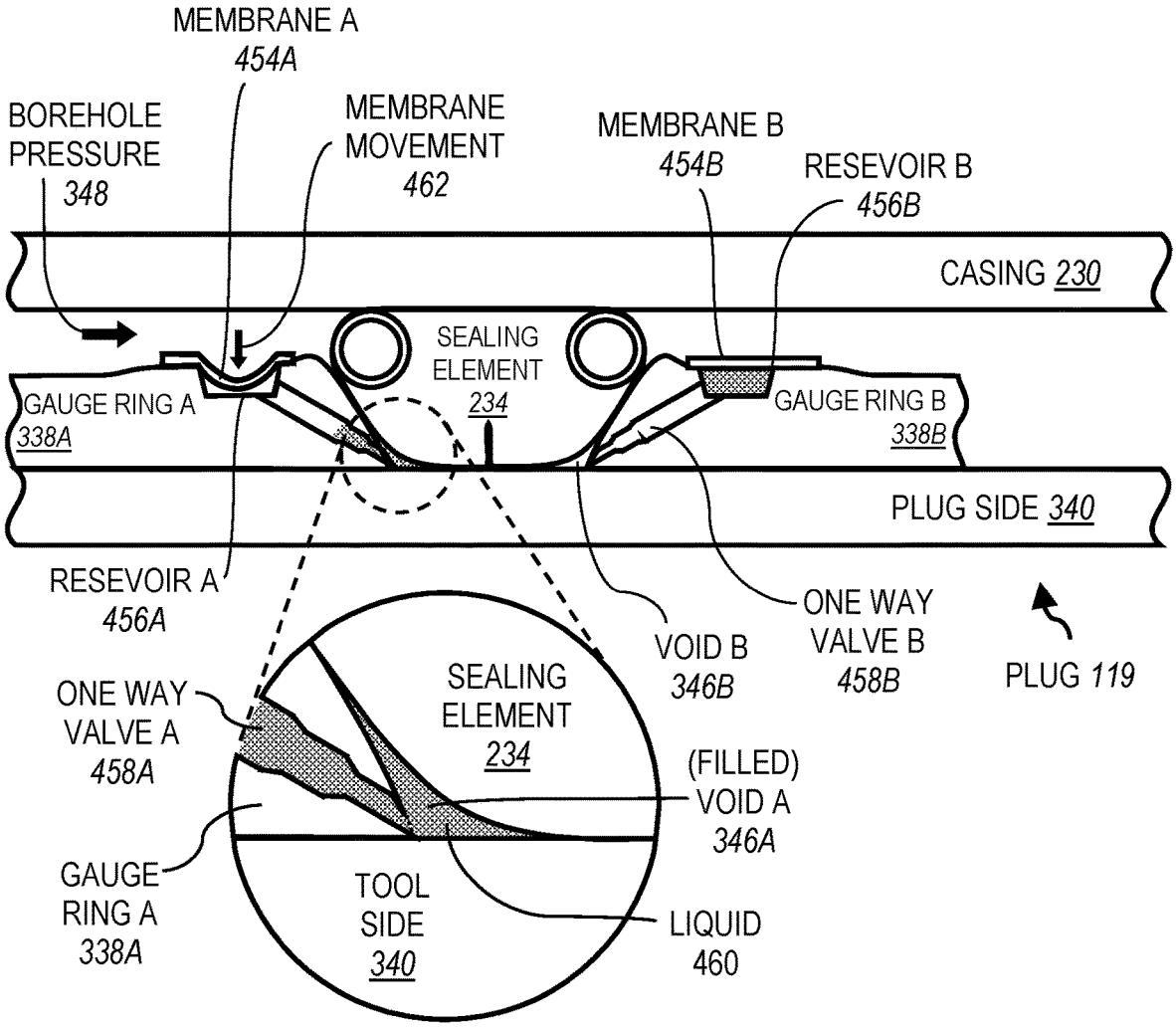
FIG. 4C is a sectional view of a portion of an example plug and a casing, after experiencing borehole pressure.

Reservoir 456 is a structure which may contain liquid 460. In any embodiment, reservoir 456 may initially be filled with liquid 460 (e.g., prior to installation of plug 119 in borehole 116). One-way valve 458 may be connected to reservoir 456 to allow for the transmission of liquid 460 out of reservoir 456 and into void 346. In any embodiment, reservoir 456 may be a channel that (wholly or partially) circumscribes plug 119. Plug 119 may include one or more reservoir(s) 456 (e.g., reservoir A 456A and reservoir B 456B are depicted in the example of FIGS. 4A-4C).

One-way valve 458 is a machine which may allow for the flow of liquid 460 in only one direction (up to a certain pressure). In any embodiment, one-way valve 458 provides a path for liquid 460 to move from reservoir 456 to void 346 due to a "cracking pressure" that is a comparatively minor pressure differential between reservoir 456 and void 346 (e.g., 1 to 5 psi). However, one-way valve 458 prevents liquid 460 from moving in the opposite direction (from void 346 to reservoir 456) until a comparatively higher "back pressure" is achieved (e.g., 50,000 psi)—causing failure. Accordingly, one-way valve 458 may be considered "one-way" in environments where the pressure difference between the downstream end of one-way valve 458 (e.g., void 346) and the upstream end of one-way valve 458 (e.g., reservoir 456) remain lower than the "back pressure" rating of one-way valve 458. In any embodiment, one or more one-way valve(s) may be disposed for each reservoir 456. As a non-limiting example, four one-way valves 458 may be disposed around plug 119 to connect a single reservoir 456 with a single void 346 (providing four paths for liquid 460 to flow). Alternatively, as another non-limiting example, only a single one-way valve 458 may be installed between reservoir 456 and void 346 (providing one path for liquid 460 to flow).

Liquid 460 is an incompressible fluid which may (at least partially) fill reservoir 456, one-way valve 458, and/or void 346. In any embodiment, liquid 460 may be moved from reservoir 456 into void 346. Once in void 346, liquid 460 may be prevented from flowing back into reservoir 456 by one-way valve 458 (unless sufficiently high pressure is exerted). Accordingly, once in void 346, liquid 460 may prevent sealing element 234 from undergoing sealing element void movement 352 (discussed in the description of FIG. 3C) as liquid 460 is incompressible. Liquid 460 may be any fluid in the liquid state of matter. One of ordinary skill in the art, provided the benefit of this detailed description, would appreciate that although liquids may not be strictly incompressible on an atomic scale, liquids may be considered "incompressible" when compared to a gaseous fluid (e.g., the contents of void 346 prior to the injection of liquid 460).

—FIG. 4B—

FIG. 4B is a sectional view of a portion of an example plug and a casing, after expansion of the sealing element.

Similar to the configuration depicted in FIG. 3B, gauge ring movement 342 causes gauge ring B 338B to move against sealing element 234. In turn, sealing element 234 undergoes sealing element expansion 344 and presses against casing 230.

As shown in FIG. 4B, borehole pressure 348 (and/or a temperature differential) does not (yet) exist in borehole 116. Accordingly, liquid 460 remains in each reservoir (reservoir A 454A and reservoir B 454B) and sealing element 234 is not undergoing seal string movement 350 or sealing element void movement 352.

—FIG. 4C—

FIG. 4C is a sectional view of a portion of an example plug and a casing, after experiencing borehole pressure.

Similar to the configuration described in FIG. 3C, borehole pressure 348 is experienced on one side of plug 119. In the example of FIG. 4C, (higher) borehole pressure 348 emanates on the side of gauge ring A 338A. However, membrane A 454A undergoes membrane movement 462—instead of sealing element 234 experiencing seal string movement 350 and/or sealing element void movement 352.

Membrane movement 462 is the motion of membrane 454 into reservoir 456. In any embodiment, membrane 454 may be sufficiently flexible as to allow for expansion into reservoir 456. Further, when membrane 454 is expanded into reservoir 456, contents of reservoir 456 (e.g., liquid 460) may be forced out of reservoir 456 through an orifice (e.g., via one-way valve 458).

In any embodiment, the pressure required to cause membrane movement 462 may be lower than the pressure required to cause seal string movement 350 and/or sealing element void movement 352. Accordingly, as shown in the example of FIG. 4C, borehole pressure 348 causes membrane movement 462 thereby forcing liquid 460 from reservoir A 456A through one-way valve A 458A and into void A 346A. Thus, sealing element 234 (and seal strings 336 thereof) are prevented from undesirable seal string movement 350 and/or sealing element void movement 352.

—FIG. 5A—

Figure 5A:
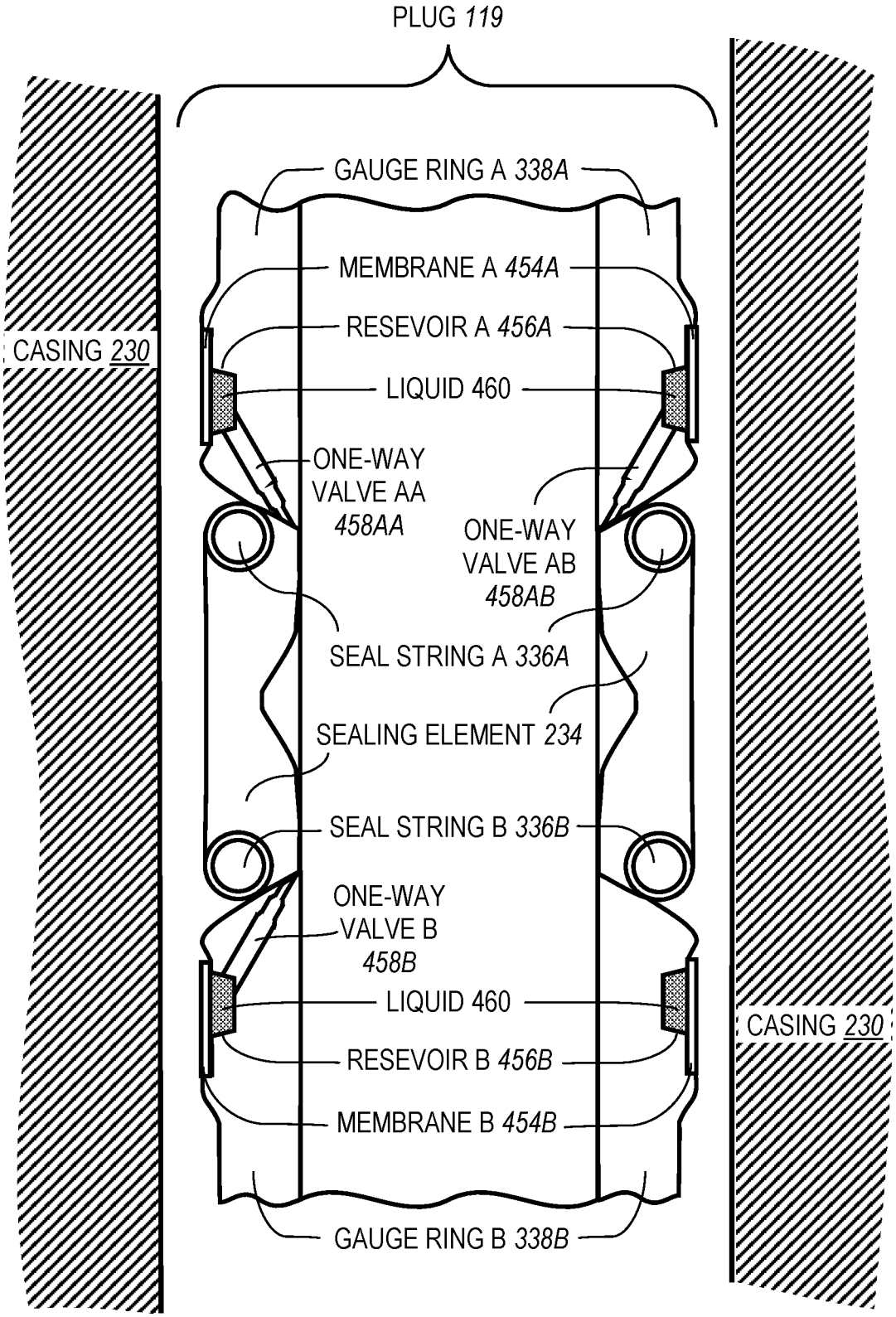
FIG. 5A is a sectional view of an example plug in a casing, prior to expansion of the sealing element.

FIG. 5A is a sectional view of an example plug in a casing, prior to expansion of the sealing element.

As shown in the example of FIG. 5A, plug 119 is placed in borehole 116 lined with casing 230. To avoid cluttering the figure, anchoring mechanism 232 is not depicted, but assume anchoring mechanism 232 is rigidly holding plug 119 centered in casing 230.

Sealing element 234 is not expanded and therefore plug 119 is not separating the volumes of borehole 116. Reservoir A 456A is filled with liquid 460 and reservoir B 456B is filled with liquid. Reservoir A 456A is attached to (at least) two one-way valves (one-way valve AA 458AA and one-way valve AB 458AB). Reservoir B 456B is attached to (at least) a single one-way valve (one-way valve B 458B).

—FIG. 5B—

Figure 5B:
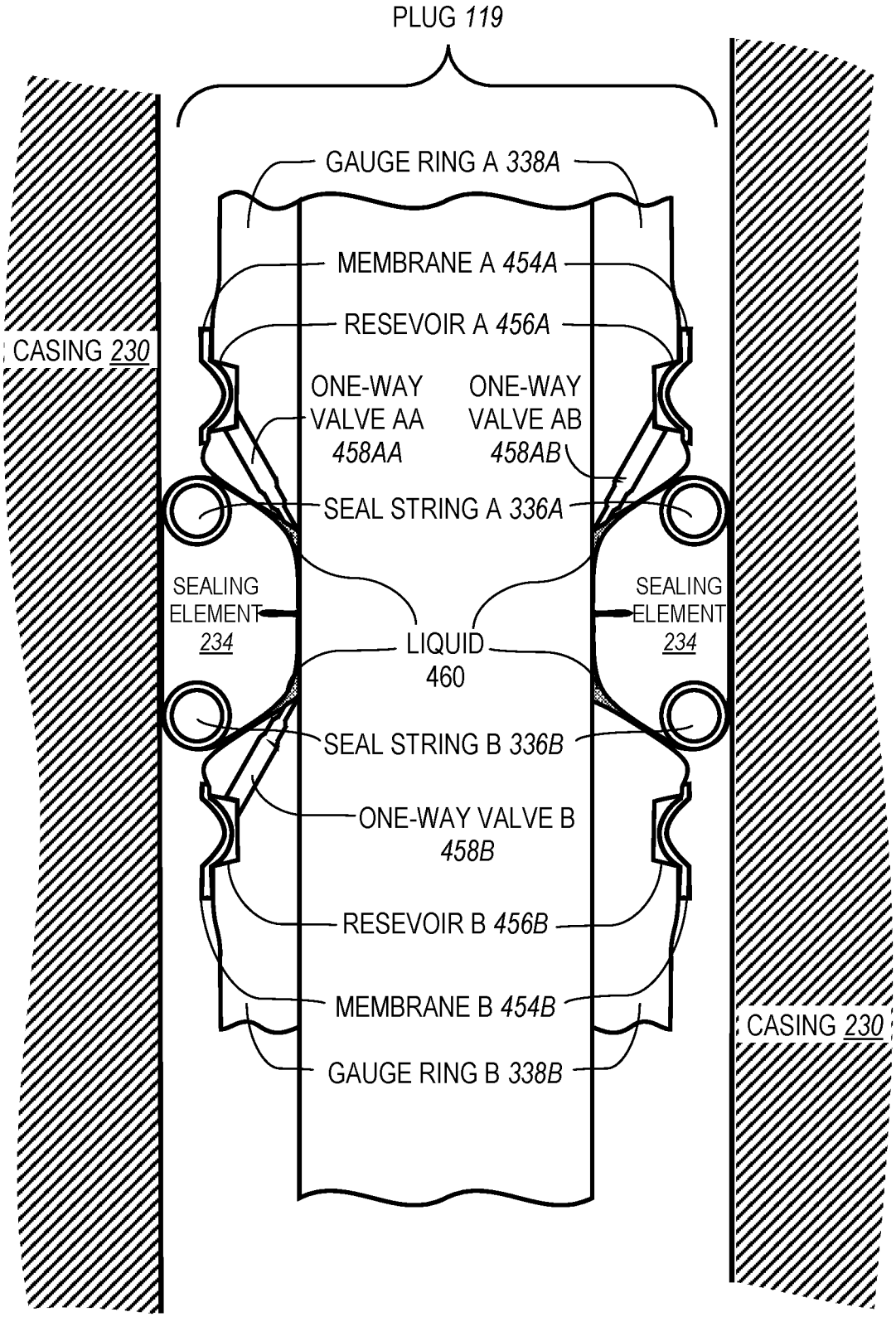
FIG. 5B is a sectional view of an example plug in a casing, after the expansion of the sealing element.

FIG. 5B is a sectional view of an example plug in a casing, after the expansion of the sealing element.

Continuing with the example shown in FIG. 5A, gauge ring B 338B is translated along the body of plug 119 and pressed into sealing element 234. In turn, sealing element 234 undergoes sealing element expansion 344 to expand sealing element 234 to press against casing 230—thereby separating the volumes of borehole 116. Further, sealing element expansion 344 creates voids 346 (not shown) on both sides of sealing element 234.

At some further instance, on both sides of plug 119 an increase in pressure (i.e., borehole pressure 348) and/or a temperature difference exists in borehole 116. Borehole pressure 348 (and/or a temperature difference) causes both membranes 454 (membrane A 454A and membrane B 454B) to undergo membrane movement 462.

In turn, liquid 460 is forced through the three one-way valves 458 (458AA, 458 AB, 458B) and into the two voids 346. Consequently, sealing element 234 cannot undergo sealing element void movement 352 as voids 346 are filled with incompressible fluid (i.e., liquid 460).

—Solutions and Improvements—

The methods and systems described above are an improvement over the current technology as the methods and systems described herein provide for a plug that uses a liquid (an incompressible fluid) injected into the voids around a sealing element. When a liquid is injected into the voids, the sealing element cannot move and shift into the voids, thereby preventing separation of the sealing element with the casing.

Accordingly, such technology is advantageous as the sealing element maintains more consistent contact with the casing, the life of the sealing element may be prolonged as the sealing element experiences less movement, and the sealing element is provided with less opportunity to separate from the borehole casing (e.g., reducing the chances of partial and/or total failure).

—Statements—

The systems and methods may comprise any of the various features disclosed herein, comprising one or more of the following statements.

Statement 1: A plug for sealing a borehole, comprising: a sealing element forming a void; a reservoir adapted to store a liquid; and a one-way valve connecting the reservoir to the void.

Statement 2: The plug of statement 1, wherein the plug further comprises a membrane covering the reservoir, and wherein the membrane is exposed in the borehole.

Statement 3: The plug of statement 2, wherein a borehole pressure causes the membrane to undergo membrane movement.

Statement 4: The plug of statement 3, wherein the membrane movement causes the liquid to move from the reservoir to the void.

Statement 5: The plug of statement 4, wherein the liquid is transported via the one-way valve.

Statement 6: The plug of statement 5, wherein the one-way valve is configured to prevent the liquid from flowing from the void to the reservoir.

Statement 7: The plug of statement 3-6, wherein the sealing element does not move into the void due to the liquid.

Statement 8: The plug of any of statements 1-7, wherein the plug further comprises a gauge ring configured to cause the sealing element to undergo sealing element expansion.

Statement 9: The plug of statement 8, wherein the one-way valve is disposed in the gauge ring.

Statement 10: The plug of statement 9, wherein the one-way valve is configured to allow the liquid to flow from the reservoir to the void, and wherein the one-way valve is configured to prevent the liquid from flowing from the void to the reservoir.

Statement 11: A method for sealing a borehole, comprising: lowering a plug into the borehole, wherein the plug comprises: a sealing element; a reservoir comprising a liquid; and a one-way valve connected to the reservoir; causing the sealing element to undergo sealing element expansion, wherein the sealing element expansion causes the sealing element to make circumferential contact with a casing of the borehole, and wherein the sealing element expansion causes the sealing element to create a void.

Statement 12: The method of statement 11, wherein after causing the sealing element to undergo the sealing element expansion, the one-way valve connects to the void.

Statement 13: The method of statement 12, wherein when the plug experiences borehole pressure, the liquid is moved from the reservoir to the void.

Statement 14: The method of statement 13, wherein the liquid is transported via the one-way valve.

Statement 15: The method of statement 14, wherein the one-way valve is configured to prevent the liquid from flowing from the void to the reservoir.

Statement 16: The method of statement 15, wherein a membrane covers the reservoir.

Statement 17: The method of statement 16, wherein the borehole pressure causes the membrane to move the liquid from the reservoir into the void.

Statement 18: The method of any of statements 11-17, wherein the sealing element expansion is caused by moving a gauge ring against the sealing element.

Statement 19: The method of statement 18, wherein the void is formed between the sealing element and the gauge ring.

Statement 20: The method of statement 19, wherein the one-way valve is disposed in the gauge ring.

—General Notes—

As it is impracticable to disclose every conceivable embodiment of the technology described herein, the figures, examples, and description provided herein disclose only a limited number of potential embodiments. One of ordinary skill in the art would appreciate that any number of potential variations or modifications may be made to the explicitly disclosed embodiments, and that such alternative embodiments remain within the scope of the broader technology. Accordingly, the scope should be limited only by the attached claims. Further, the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. Certain technical details, known to those of ordinary skill in the art, may be omitted for brevity and to avoid cluttering the description of the novel aspects.

For further brevity, descriptions of similarly named components may be omitted if a description of that similarly named component exists elsewhere in the application. Accordingly, any component described with respect to a specific figure may be equivalent to one or more similarly named components shown or described in any other figure, and each component incorporates the description of every similarly named component provided in the application (unless explicitly noted otherwise). A description of any component is to be interpreted as an optional embodiment-which may be implemented in addition to, in conjunction with, or in place of an embodiment of a similarly-named component described for any other figure.

—Lexicographical Notes—

As used herein, adjective ordinal numbers (e.g., first, second, third, etc.) are used to distinguish between elements and do not create any particular ordering of the elements. As an example, a "first element" is distinct from a "second element", but the "first element" may come after (or before) the "second element" in an ordering of elements. Accordingly, an order of elements exists only if ordered terminology is expressly provided (e.g., "before", "between", "after", etc.) or a type of "order" is expressly provided (e.g., "chronological", "alphabetical", "by size", etc.). Further, use of ordinal numbers does not preclude the existence of other elements. As an example, a "table with a first leg and a second leg" is any table with two or more legs (e.g., two legs, five legs, thirteen legs, etc.). A maximum quantity of elements exists only if express language is used to limit the upper bound (e.g., "two or fewer", "exactly five", "nine to twenty", etc.). Similarly, singular use of an ordinal number does not imply the existence of another element. As an example, a "first threshold" may be the only threshold and therefore does not necessitate the existence of a "second threshold".

As used herein, the word "data" may be used as an "uncountable" singular noun—not as the plural form of the singular noun "datum". Accordingly, throughout the application, "data" is generally paired with a singular verb (e.g., "the data is modified"). However, "data" is not redefined to mean a single bit of digital information. Rather, as used herein, "data" means any one or more bit(s) of digital information that are grouped together (physically or logically). Further, "data" may be used as a plural noun if context provides the existence of multiple "data" (e.g., "the two data are combined").

As used herein, the term "operative connection" (or "operatively connected") means the direct or indirect connection between devices that allows for interaction in some way (e.g., via the exchange of information). For example, the phrase 'operatively connected' may refer to a direct connection (e.g., a direct wired or wireless connection between devices) or an indirect connection (e.g., multiple wired and/or wireless connections between any number of other devices connecting the operatively connected devices).

As used herein, indefinite articles "a" and "an" mean "one or more". That is, the explicit recitation of "an" element does not preclude the existence of a second element, a third element, etc. Further, definite articles (e.g., "the", "said") mean "any one of" (the "one or more" elements) when referring to previously introduced element(s). As an example, there may exist "a processor", where such a recitation does not preclude the existence of any number of other processors. Further, "the processor receives data, and the processor processes data" means "any one of the one or more processors receives data" and "any one of the one or more processors processes data". It is not required that the same processor both (i) receive data and (ii) process data. Rather, each of the steps ("receive" and "process") may be performed by different processors.

As used herein, "machine" means any collection of components assembled to form a tool, structure, or other apparatus. A collection of components may be grouped together and referred to as a single 'machine' based on the functionality of the machine enabled by the combination of the components. As a non-limiting example, a "car engine" is a machine assembled from the components of an engine block, one or more piston(s), a camshaft, etc. that, when combined, function to convert chemical energy into mechanical energy. Further, a machine may be constructed using one or more other machine(s). As a non-limiting example, an automobile may be an assembly of an engine, a drivetrain, and a steering system—each an independent machine—but assembled to form a larger 'automobile' machine which functions to provide transportation.

What is claimed is:

1. A plug for sealing a borehole, comprising:

a sealing element forming a void;

a reservoir adapted to store a liquid;

a one-way valve connecting the reservoir to the void; and a membrane covering the reservoir and exposed in the borehole, wherein a borehole pressure causes the membrane to undergo membrane movement.

2. The plug of claim 1, wherein the membrane movement causes the liquid to move from the reservoir to the void.

3. The plug of claim 2, wherein the liquid is transported via the one-way valve.

4. The plug of claim 3, wherein the one-way valve is configured to prevent the liquid from flowing from the void to the reservoir.

5. The plug of claim 2, wherein the sealing element does not move into the void due to the liquid.

6. The plug of claim 1, wherein the plug further comprises a gauge ring configured to cause the sealing element to undergo sealing element expansion.

7. The plug of claim 6, wherein the one-way valve is disposed in the gauge ring.

8. The plug of claim 7, wherein the one-way valve is configured to allow the liquid to flow from the reservoir to the void.

9. The plug of claim 8, wherein the one-way valve is configured to prevent the liquid from flowing from the void to the reservoir.

10. The plug of claim 1, wherein the plug is affixed to an anchoring mechanism.

11. A method for sealing a borehole, comprising:

lowering a plug into the borehole, wherein the plug comprises:

a sealing element;

a reservoir comprising a liquid; and a one-way valve connected to the reservoir; and causing the sealing element to undergo sealing element expansion, wherein the sealing element expansion causes the sealing element to make circumferential contact with a casing of the borehole, and wherein the sealing element expansion causes the sealing element to create a void.

12. The method of claim 11, wherein after causing the sealing element to undergo the sealing element expansion, the one-way valve connects to the void.

13. The method of claim 12, wherein when the plug experiences borehole pressure, the liquid is moved from the reservoir to the void.

14. The method of claim 13, wherein the liquid is transported via the one-way valve.

15. The method of claim 14, wherein the one-way valve is configured to prevent the liquid from flowing from the void to the reservoir.

16. The method of claim 15, wherein a membrane covers the reservoir.

17. The method of claim 16, wherein the borehole pressure causes the membrane to move the liquid from the reservoir into the void.

18. The method of claim 11, wherein the sealing element expansion is caused by moving a gauge ring against the sealing element.

19. The method of claim 18, wherein the void is formed between the sealing element and the gauge ring.

20. The method of claim 19, wherein the one-way valve is disposed in the gauge ring.

* * * * *